US006561434B2

(12) United States Patent
Kaplan

(10) Patent No.: US 6,561,434 B2
(45) Date of Patent: May 13, 2003

(54) STRAW FOR SIPPING LIQUID

(76) Inventor: Barry Kaplan, 159 E. 30th St. - PH "A", New York, NY (US) 10016

( * ) Notice: Subject to any disclaimer, the term of this patent is extended or adjusted under 35 U.S.C. 154(b) by 0 days.

(21) Appl. No.: 09/876,866

(22) Filed: Jun. 8, 2001

(65) Prior Publication Data

US 2002/0185547 A1 Dec. 12, 2002

(51) Int. Cl.[7] ..... A47G 21/18
(52) U.S. Cl. ..... 239/33; 239/24
(58) Field of Search ..... 239/16, 24, 33

(56) References Cited

U.S. PATENT DOCUMENTS 1,847,879 A * 3/1932 Knecht ..... 215/389
3,718,282 A * 2/1973 Pizzoferrato ..... 239/33
3,832,069 A * 8/1974 Petsch ..... 15/50.1
4,239,123 A * 12/1980 Lang et al. ..... 220/717
4,441,640 A * 4/1984 Lottick ..... 239/240
4,699,318 A * 10/1987 Donatello et al. ..... 215/388
4,867,379 A * 9/1989 Hunter ..... 239/240
6,056,206 A * 5/2000 Whiton ..... 215/388

* cited by examiner

*Primary Examiner*—Christopher Kim
(74) *Attorney, Agent, or Firm*—Charles E. Baxley

(57) ABSTRACT

A straw for sipping a liquid that includes a tube, a base that depends from the tube, and protrusions that depend from the base. The base has a primary throughbore that is in fluid communication with the tube and allows the liquid that is below the base to be drawn up therethrough and up through the tube so as to provide a main flow. The base further has at least one secondary throughbore that is independent of both the primary throughbore and the tube and allows the liquid that is above the base to be drawn down therethrough and up through the primary throughbore and up through the tube so as to provide a flow that supplements the main f low. The protrusions are cylindrically-shaped and formed, and separated from each other, by fine grooves that are approximately 1/64" wide so as to allow the base to crush and mix sugar granules in the liquid.

1 Claim, 3 Drawing Sheets

STRAW FOR SIPPING LIQUID

BACKGROUND OF THE INVENTION

1. Field of the Invention

The present invention relates to the class of fluid sprinkling, spraying, and diffusing. More particularly, the present invention relates to the subclass of portable drinking tubes and straws.

2. Description of the Prior Art

Numerous innovations for straws have been provided in the prior art. Even though these innovations may be suitable for the specific individual purposes to which they address, however, they differ from the present invention.

FOR EXAMPLE, U.S. Pat. No. 6,056,206 to Whiton teaches a de-rice having a generally upright standing tube straw or tube member having an aperture therein which runs the full length of the tube therein. The tube has a bottom base plate located on its lower end which is attached to the tube and supported by brace members near the bottom of the tube. The aperture of the tube extends through the base plate. The base plate is equipped with numerous protrusions on its underside which are used to crush and extract juice and pulp from slices of fruit in the drink mixture. Also provided is longitudinal vertical slots or apertures located between buttresses which slots serve as means to prevent the tube or straw from becoming clogged with pulp or sealed to the drink vessel by providing additional ingress into the tube. Alternative embodiments are provided which allow the base plate to be formed into recognizable shapes such as a bottle or lemon, or having a contoured edge to aid in the juice extraction process.

Even though the innovation of Whiton may be suitable for the specific individual purposes to which it addresses, however, it would not be suitable for the purposes of the present invention as heretofore described.

Whiton does not teach, as taught by the present invention, a straw that crushes and mixes sugar granules in a liquid by virtue of protrusions that are cylindrically-shaped and formed, and separated from each other, by fine grooves that are approximately 1/64" wide, or a straw that creates a main flow that draws liquid from below and a supplemental flow that draws liquid from above, wherein the supplemental flow has reduced head loss by virtue of a round-cornered entrance for the supplemental flow, and wherein the supplemental flow creates turbulence just prior to joining the main flow which intensely mixes the liquid by virtue of disturbing the supplemental flow just prior to joining the main flow, with such joining being external to the straw.

In contradistinction, Whiton teaches a straw that extracts juice and pulp from, and then crushes, slices of fruit in the liquid by virtue of the protrusions being conically-shaped requiring first piercing by the protrusions and then crushing by the lower surface of the base. The supplemental flow that draws liquid from above does not have reduced head loss by virtue of a sharp-cornered entrance for the supplemental flow or does the supplemental flow create turbulence just prior to joining the main flow by virtue of the supplemental flow not being disturbed just prior to joining the main flow and with such joining being internal to the straw so that therefore the supplemental flow cannot intensely mix the liquid.

SUMMARY OF THE INVENTION

ACCORDINGLY, AN OBJECT of the present invention is to provide a straw for sipping a liquid that avoids the disadvantages of the prior art.

ANOTHER OBJECT of the present invention is to provide a straw for sipping a liquid that is simple to use.

STILL ANOTHER OBJECT of the present invention is to provide a straw for sipping a liquid that crushes and mixes sugar granules in a liquid.

YET ANOTHER OBJECT of the present invention is to provide a straw for sipping a liquid that creates a supplemental flow that draws liquid from above.

STILL YET ANOTHER OBJECT of the present invention is to provide a straw for sipping a liquid whose supplemental flow has reduced head loss.

YET STILL ANOTHER OBJECT of the present invention is to provide a straw for sipping a liquid whose supplemental flow creates turbulence which intensely mixes the liquid.

BRIEFLY STATED, STILL YET ANOTHER OBJECT of the present invention is to provide a straw for sipping a liquid that includes a tube, a base that depends from the tube, and protrusions that depend from the base. The base has a primary throughbore that is in fluid communication with the tube and allows the liquid that is below the base to be drawn up therethrough and up through the tube so as to provide a main flow. The base further has at least one secondary throughbore that is independent of both the primary throughbore and the tube and allows the liquid that is above the base to be drawn down therethrough and up through the primary throughbore and up through the tube so as to provide a flow that supplements the main flow. The protrusions are cylindrically-shaped and formed, and separated from each other, by fine grooves that are approximately 1/64" wide so as to allow the base to crush and mix sugar granules in the liquid.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
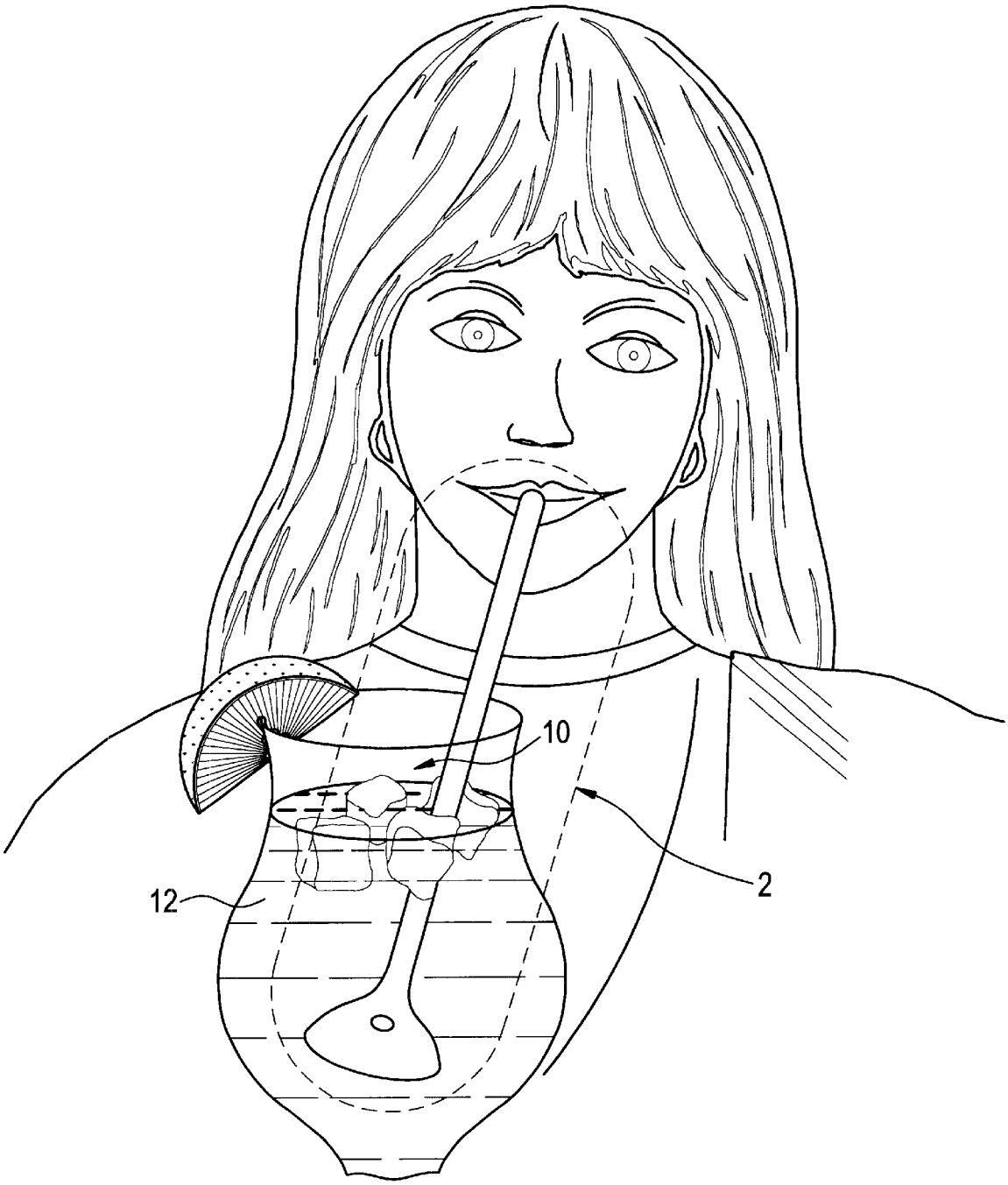
FIG. 1 is a diagrammatic perspective view of a user of the straw of the present invention sipping a liquid therethrough.

10 straw of present invention for sipping liquid 12
12 liquid
14 tube
16 base
18 lowermost end of tube 14

20 lowermost surface of base 16

21 periphery of lowermost surface 20 of base 16

22 uppermost surface of base 16

24 protrusions depending from lowermost surface 20 of base 16

26 fine grooves forming and separating protrusions 24 for allowing base 16 to crush and mix sugar granules in liquid 12

30 primary throughbore through base 16 for allowing liquid 12 that is below base 16 to be drawn up through primary throughbore 30 and up through tube 14 so as to provide main flow 32 of liquid 12

32 main flow of liquid 12

34 at least one secondary throughbore through base 16 for allowing liquid 12 that is above base 16 to be drawn down through at least one secondary throughbore 34 and up through primary throughbore 30 and up through tube 14 so as to provide supplemental flow 36 of liquid 12 that supplements main flow 32 of liquid 12

36 supplemental flow of liquid 12

38 round-cornered entrance of at least one secondary throughbore 34 at uppermost surface 22 of base 16 for reducing head loss as liquid 12 enters at least one secondary throughbore 34

DETAILED DESCRIPTION OF THE PREFERRED EMBODIMENT

Referring now to the figures, in which like numerals indicate like parts, and particularly to FIG. 1, which is a diagrammatic perspective view of a user of the straw of the present invention sipping a liquid therethrough, the straw of the present invention is shown generally at 10 for sipping a liquid 12.

The configuration of the straw 10 can best be seen in FIGS. 2–5, and as such, will be discussed with reference thereto.

Figure 2:
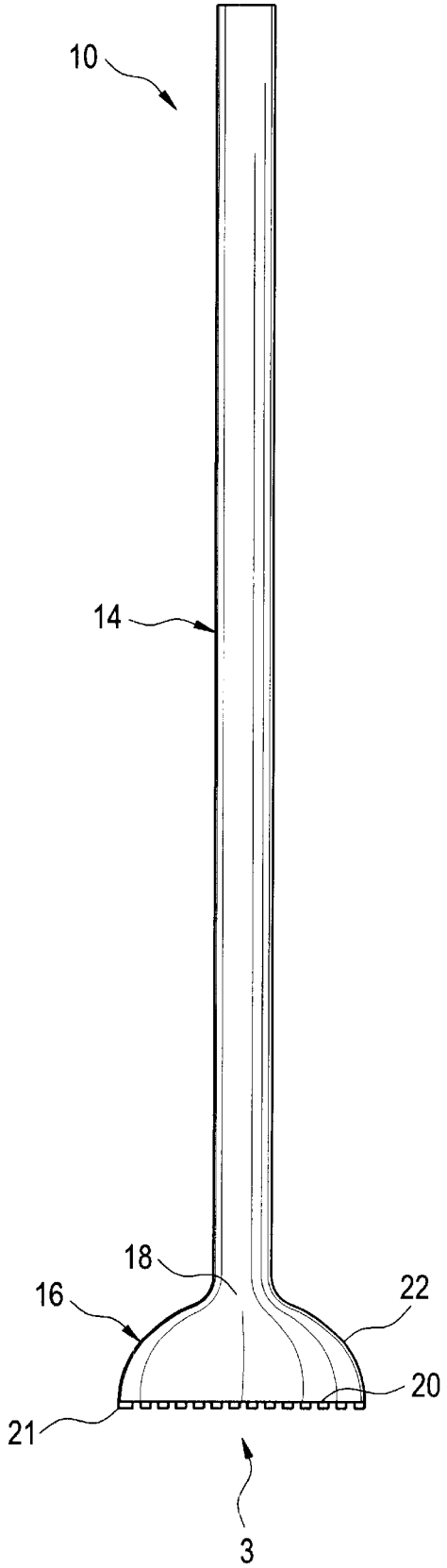
FIG. 2 is an enlarged diagrammatic side elevational view of the area generally enclosed by the dotted curve identified by ARROW 2 in FIG. 1 of the straw of the present invention.

As shown in FIG. 2, which is an enlarged diagrammatic side elevational view of the area generally enclosed by the dotted curve identified by ARROW 2 in FIG. 1 of the straw of the present invention, the straw 10 comprises a tube 14 and a base 16 that depends from, and is normal to, the tube 14.

The tube 14 has a lowermost end 18 and the base 16 has a lowermost surface 20 that is planar and has a periphery 21 that is free, and an uppermost surface 22 that is convex and depends directly and fixedly from the lowermost end 18 of the tube 14.

The lowermost end 18 of the tube 14 flares smoothly outwardly to the uppermost surface 22 of the base 16 so as to provide a strong and stable transition from the tube 14 to the base 16 by reducing stress concentration thereat.

Figure 3:
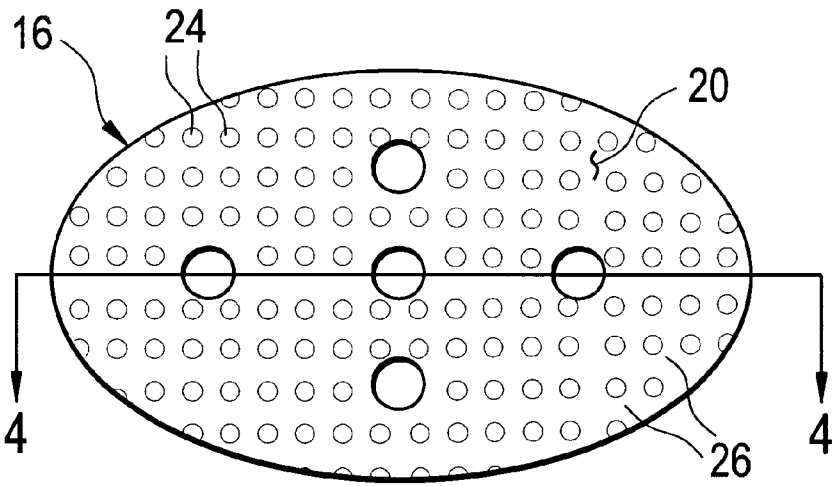
FIG. 3 is a enlarged diagrammatic bottom plan view taken generally in the direction of ARROW 3 in FIG. 2.

As shown in FIG. 3, which is an enlarged diagrammatic bottom plan view taken generally in the direction of ARROW 3 in FIG. 2, the lowermost surface 20 of the base 16 has protrusions 24 that depend therefrom that are cylindrically-shaped and formed, and separated from each other, by fine grooves 26 that are approximately 1/64 of an inch in width for allowing the base 16 to crush and mix sugar granules in the liquid 12.

Figure 4:
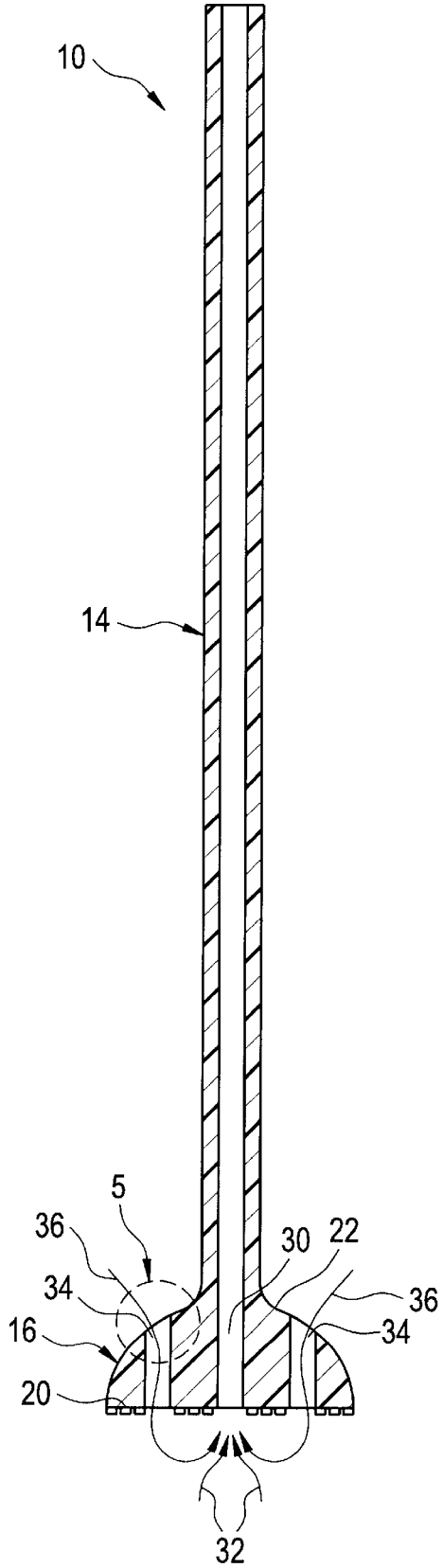
FIG. 4 is a reduced diagrammatic cross sectional view taken on line 4—4 in FIG. 3.

As shown in FIG. 4, which is a reduced diagrammatic cross sectional view taken on line 4—4 in FIG. 3, the base 16 further has a primary throughbore 30 that is in fluid communication with the tube 14 and is for allowing the liquid 12 that is below the base 16 to be drawn up through the primary throughbore 30 and up through the tube 14 so as to provide a main flow 32 of the liquid 12.

The primary throughbore 30 extends centrally through the base 16, from the uppermost surface 22 of the base 16 to the lowermost surface 20 of the base 16, and is vertically-oriented.

The base 16 further has at least one secondary throughbore 34 that is independent of both the primary throughbore 30 and the tube 14 and is for allowing the liquid 12 that is above the base 16 to be drawn down through each of the at least one secondary throughbore 34 and up through the primary throughbore 30 and up through the tube 14 so as to provide a supplemental flow 36 of the liquid 12 that supplements the main flow 32 of the liquid 12 and which creates turbulence in the liquid 12 just prior to entering the primary throughbore 30 by virtue of the supplemental flow 36 initially flowing down through each of the at least one secondary throughbore 34 and then being disturbed by changing direction abruptly up through the primary throughbore 30 and with such turbulence intensely mixing the liquid 12 just prior to entering the primary throughbore 30 by virtue of turbulence readily spreading materials dissolved in a liquid 12.

Each of the at least one secondary throughbore 34 extends from the uppermost surface 22 of the base 16 to the lowermost surface 20 of the base 16, is disposed outboard of, and parallel to, the primary throughbore 30, and is vertically-oriented, and when the at least one secondary throughbore 34 is a plurality of secondary throughbores 34, the plurality of secondary throughbores 34 straddle the primary throughbore 30.

Figure 5:
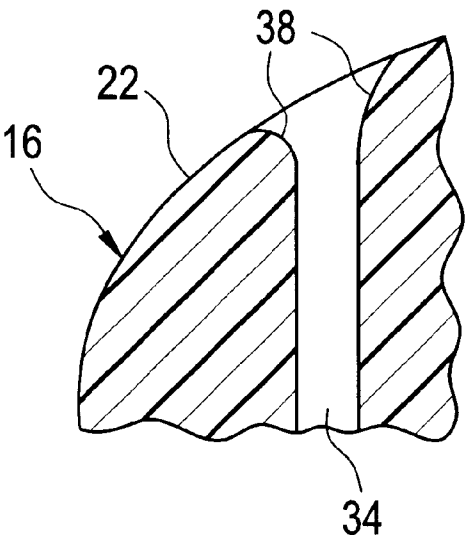
FIG. 5 is an enlarged diagrammatic cross sectional view of the area generally enclosed by the dotted curve identified by ARROW 5 in FIG. 4.

As shown in FIG. 5, which is an enlarged diagrammatic cross sectional view of the area generally enclosed by the dotted curve identified by ARROW 5 in FIG. 4, each of the at least one secondary throughbore 34 has a round-cornered entrance 38 at the uppermost surface 22 of the base 16 for reducing head loss as the liquid 12 enters each of the at least one secondary throughbore 34.

Head loss is the additional loss of mechanical energy per unit weight of a flow as the flow enters a conduit, and is conventionally expressed as follows:

$$h_L = K(V^2/2g)$$

wherein $h_L$ is the head loss

K is a dimensionless coefficient

V is the mean speed in the conduit

It is apparent that the head loss $h_L$ is directly proportional to the dimensionless coefficient K.

The value of K depends on the shape of the entrance of a conduit. Empirically, the value of K for a sharp-cornered entrance to a conduit has been found to be ½, while the value of K for a round-cornered entrance to a conduit has been found to be ¼. Principles of Fluid Mechanics; W. H. Li et al.; Addison-Wesly Publishing Company, Inc.; 1964.

So it can be seen that when the entrance to a conduit is round-cornered, the head loss of a flow entering the conduit is half as much as that experienced by a flow entering a conduit whose entrance is sharp-cornered.

It will be understood that each of the elements described above, or two or more together, may also find a useful application in other types of constructions differing from the types described above.

While the invention has been illustrated and described as embodied in a straw for sipping a liquid, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A straw for sipping a liquid, comprising:

a) a tube; and b) a base;

wherein said base depends from said tube;

wherein said tube has a lowermost end;

wherein said base has an uppermost surface;

wherein said base has a lowermost surface;

wherein said base has a primary throughbore;

wherein said primary throughbore is in fluid communication with said tube;

wherein said primary throughbore is for allowing the liquid that is below said base to be drawn up through said primary throughbore and up through said tube so as to provide a main flow of the liquid;

wherein said base has at least one secondary throughbore;

wherein each of said at least one secondary throughbore is independent of said primary throughbore;

wherein each of said at least one secondary throughbore is independent of said tube;

wherein each of said at least one secondary throughbore is for allowing the liquid that is above said base to be drawn down through each of said at least one secondary throughbore and up through said primary throughbore and up through said tube so as to provide a supplemental flow of the liquid that supplements the main flow of the liquid and which creates turbulence in the liquid just prior to entering said primary throughbore by virtue of the supplemental flow initially flowing down through each of said at least one secondary throughbore and then being disturbed by changing direction abruptly up through said primary throughbore and with such turbulence intensely mixing the liquid just prior to entering said primary throughbore by virtue of turbulence readily spreading materials dissolved in a liquid;

wherein said base is normal to said tube;

wherein said uppermost surface of said base depends directly from said lowermost end of said tube;

wherein said uppermost surface of said base depends fixedly from said lowermost end of said tube;

wherein said lowermost end of said tube flares outwardly to said uppermost surface of said base so as to provide a strong and stable transition from said tube to said base by reducing stress concentration thereat;

wherein said uppermost surface of said base is convex;

wherein said lowermost surface of said base is planar;

wherein said lowermost surface of said base has a periphery;

wherein said periphery of said lowermost surface of said base is free;

wherein said lowermost surface of said base has protrusions thereon;

wherein said protrusions depend from said lowermost surface of said base;

wherein said protrusions are cylindrically-shaped and formed, and separated from each other, by fine grooves that are approximately 1/64 of an inch in width for allowing said base to crush and mix sugar granules in the liquid;

wherein said primary throughbore extends centrally through said base;

wherein said primary throughbore is vertically-oriented;

wherein said primary throughbore extends from said uppermost surface of said base to said lowermost surface of said base;

wherein each of said at least one secondary throughbore extends from said uppermost surface of said base to said lowermost surface of said base;

wherein each of said at least one secondary throughbore is vertically-oriented;

wherein said at least one secondary throughbore is a plurality of secondary throughbores;

wherein said plurality of secondary throughbores straddle said primary throughbore;

wherein each of said at least one secondary throughbore is disposed outboard of said primary throughbore;

wherein each of said at least one secondary throughbore is parallel to said primary throughbore; and wherein each of said at least one secondary throughbore has a round-cornered entrance at said uppermost surface of the base for reducing head loss as the liquid enters each of said at least one secondary throughbore.

* * * * *